US007887231B2

(12) United States Patent
Suchan et al.

(10) Patent No.: US 7,887,231 B2
(45) **Date of Patent: *Feb. 15, 2011**

(54) DEVICE HAVING SEALED BREAKABLE CHAMBERS FOR STORING AND DISPENSING VISCOUS SUBSTANCES

(75) Inventors: Matthias Suchan, Hachenburg (DE); Alexander Bublewitz, Herborn (DE)

(73) Assignee: Kettenbach GmbH & Co. KG, Eschenburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/589,098

(22) Filed: Oct. 16, 2009

(65) Prior Publication Data

US 2010/0039882 A1 Feb. 18, 2010

Related U.S. Application Data

(62) Division of application No. 10/513,897, filed as application No. PCT/EP03/11719 on Oct. 23, 2003, now Pat. No. 7,625,114.

(30) Foreign Application Priority Data

Nov. 2, 2002 (DE) ..... 102 51 050
Jun. 20, 2003 (DE) ..... 203 09 546 U

(51) Int. Cl.
*B65D 81/32* (2006.01)

(52) U.S. Cl. ..... 366/130; 222/94; 206/219

(58) Field of Classification Search ..... 366/130, 366/339; 222/94, 145.1, 145.5, 145.6; 206/219–221
See application file for complete search history.

(56) References Cited

U.S. PATENT DOCUMENTS 2,487,236 A 11/1949 Greenberg
3,266,625 A * 8/1966 Hardman ..... 206/568
3,286,992 A 11/1966 Armeniades et al.
4,130,245 A * 12/1978 Bryson ..... 239/34
4,534,509 A 8/1985 Holzner
4,790,429 A 12/1988 Fukushima (Continued)

FOREIGN PATENT DOCUMENTS

DE 31 22 237 1/1983

(Continued)

*Primary Examiner*—Charles E Cooley
(74) *Attorney, Agent, or Firm*—Collard & Roe, P.C.

(57) ABSTRACT

The invention relates, among other things, to a device for storing and dispensing viscous substances, which are to be mixed from at least two components for use, having a film-like carrier, for example, in which at least three or four depressions are formed, for example arranged next to one another in a row, which are open towards the top, at first, so that one of the components, in each instance, can be introduced from the top into one of two center depressions, in each instance, i.e. depressions that are adjacent and are arranged at essentially the same distance from a bending line, and afterwards, the two center depressions can be sealed with a cover film, towards the outside, forming a chamber, in each instance, in such a manner that between each center chamber and at least one adjacent outer depression, a connection channel that opens towards at least one outer depression when pressure is applied to the center chamber, in each instance, by way of a planned breakage point, remains.

16 Claims, 4 Drawing Sheets

U.S. PATENT DOCUMENTS

| | | | | |
|---|---|---|---|---|
| 4,844,251 | A | 7/1989 | Gueret | |
| 5,080,262 | A | 1/1992 | Herold et al. | |
| 5,240,415 | A | 8/1993 | Haynie | |
| 5,287,961 | A | 2/1994 | Herran | |
| 6,105,761 | A | 8/2000 | Peuker et al. | |
| 6,135,632 | A | 10/2000 | Flint | |
| 6,543,611 | B1 | 4/2003 | Peuker et al. | |
| 6,612,769 | B2 * | 9/2003 | Lee et al. | 401/183 |
| 6,715,645 | B2 | 4/2004 | Peuker et al. | |
| 7,086,528 | B2 | 8/2006 | Raia et al. | |
| 7,097,075 | B2 * | 8/2006 | Peuker et al. | 222/94 |
| 7,172,066 | B2 | 2/2007 | Peuker et al. | |
| 7,325,703 | B2 | 2/2008 | Gherdan et al. | |
| 7,357,248 | B2 | 4/2008 | Sivakumar et al. | |
| 7,556,147 | B2 | 7/2009 | Leiner et al. | |
| 7,625,114 | B2 * | 12/2009 | Suchan et al. | 366/130 |
| 2003/0047466 | A1 | 3/2003 | Matthews | |
| 2003/0136799 | A1 | 7/2003 | Peuker et al. | |
| 2004/0029171 | A1 | 2/2004 | Wagner et al. | |
| 2004/0065679 | A1 * | 4/2004 | Peuker et al. | 222/107 |
| 2005/0150904 | A1 * | 7/2005 | Suchan et al. | 222/94 |
| 2006/0118434 | A1 | 6/2006 | Leiner et al. | |
| 2007/0125667 | A1 | 6/2007 | Lee et al. | |
| 2008/0123465 | A1 | 5/2008 | Heusser et al. | |
| 2008/0230298 | A1 | 9/2008 | Buch et al. | |
| 2009/0032413 | A1 | 2/2009 | Huber et al. | |
| 2009/0114677 | A1 | 5/2009 | Stuart | |
| 2010/0039882 | A1 * | 2/2010 | Suchan et al. | 366/130 |

FOREIGN PATENT DOCUMENTS

| | | | |
|---|---|---|---|
| DE | 33 10 215 | | 9/1984 |
| DE | 37 17 512 | | 12/1987 |
| DE | 37 26 876 | | 2/1988 |
| DE | 93 07 726 | | 7/1993 |
| DE | 201 11 705 | | 10/2001 |
| DE | 100 34 647 | | 4/2002 |
| DE | 100 56 212 | | 5/2002 |
| EP | 0 770 021 | | 5/1997 |
| EP | 0 895 943 | | 2/1999 |
| EP | 1 108 656 | | 6/2001 |
| JP | 11-227843 | | 8/1999 |
| JP | 2009-112666 | | 5/2009 |
| WO | WO 96/03326 | | 2/1996 |
| WO | WO 02/06820 | | 1/2001 |
| WO | WO 01/26994 | | 4/2001 |
| WO | 01/46037 | A1 * | 6/2001 |
| WO | WO 01/46037 | | 6/2001 |
| WO | WO 01/62175 | | 8/2001 |
| WO | WO 01/64547 | | 9/2001 |
| WO | WO 02/48002 | | 6/2002 |

* cited by examiner

DEVICE HAVING SEALED BREAKABLE CHAMBERS FOR STORING AND DISPENSING VISCOUS SUBSTANCES

CROSS REFERENCE TO RELATED APPLICATIONS

This application is a divisional claiming priority under 35 U.S.C. §120 of parent application Ser. No. 10/513,897 filed on Nov. 9, 2004, which has now issued as U.S. Pat. No. 7,625,114 B2 and which claims the benefit as a National Stage entry of a PCT application pursuant to 35 U.S.C. §371 of International Application No. PCT/EP03/11719 filed on Oct. 23, 2003, published in the German language, which in turn claims priority in its parent case, under 35 U.S.C. §119 of German Application No. 102 51 050.4 filed on Nov. 2, 2002 and German Application No. 203 09 546.4 filed on Jun. 20, 2003.

BACKGROUND OF THE INVENTION

1. Field of the Invention

The invention relates to a device for storing and dispensing viscous substances. In this connection, viscous is understood to mean all substances capable of flow, i.e. liquid to paste-like substances, which can also be gel-like, for example. For use, the substances can be mixed from at least two components. The components themselves can also be viscous, but not all of them have to be viscous, only at least one does.

The viscous substances are, for example, adhesives or sealing materials, such as those used in dental technology. In the case of such applications, the individual components are currently stored separately, or in bottles. For use in the dental sector, only very small amounts are usually used, for example between 0.01 and 10 ml. Storing the components to be used in use in individual bottles and subsequently mixing them in a crucible or the like brings with it the disadvantage that the components are exposed to the environment before being mixed and that solvents can escape, for example, or, particularly in the case of light-cured substances, that curing already starts before and/or during mixing. Furthermore, it is difficult to meter such small amounts of substances, so that the desired mixture ratio is not precisely achieved. The substances, after having been mixed, are applied to the application site by means of a brush or similar aid, for example, thereby additionally causing the risk of contamination of the individual components stored in the bottles.

2. The Prior Art

A container for liquids in the form of an oblong, flat bag is known from DE 37 17 512 A1 (Ivers-Lee), which is divided into two compartments. Two chambers that are arranged one above the other and separate from one another are accommodated in the first compartment, while a single third chamber that is separated from the first two chambers is accommodated in the second compartment. The first two chambers are formed by two outer films and a center film, the circumferential edges of which are sealed. The first two chambers are filled with liquids that are different from one another. The third chamber, which directly follows the first two chambers, and is formed by the two outer films of the first two chambers, does not contain any liquid. The first two chambers make a transition into a tip that points in the direction of the third chamber, the sealed edges of which have a lesser laminate adhesion than that of the sealed circumferential edges. The container makes it possible to mix at least two liquids, if necessary also with a non-liquid substance. At the end of the third chamber that faces away from the first two chambers, a planned tear-open point is provided, in the form of a tear-open notch. By tearing the end part of the third chamber open at this point, the liquid content can exit from the third chamber. This known container for liquids is supposed to be used in the pharmaceutical sector, for example, or in the case of adhesives. No contamination of the liquids or the non-liquid substances can take place in the container, because the circumferential edges of the container are hermetically sealed. Because of these tightly sealed circumferential edges, no leakage of the liquids can take place, either.

A disadvantage of the known container for liquids is, for one thing, the difficulty in introducing the components to be mixed, in the production of the container and, for another, the difficulty in emptying the third chamber during handling of the container, since it can be difficult to tear off its end part, or a tool such as a knife or scissors is required, and thereby there is the risk that the mixed fluid can be splashed out. Also, two hands are required to empty the container, since it must be compressed flat to dispense the liquid, so that the liquid is not merely moved within the container. Furthermore, metering of the amount of fluid dispensed from the container is almost impossible.

A device for storing and dispensing substances, preferably liquids in small amounts, is known from EP 0 895 943 A2 (Espe Dental), which comprises a container formed by two films heat-sealed with one another, whereby the films form a chamber to accommodate the liquid, as well as a pocket for holding a brush, with one another. A planned breakage point is formed between the chamber and the pocket, in the connection of the two films, which is released by means of pressure on the chamber, so that the liquid is pressed from the chamber into the pocket and the tip of the brush located there can be wetted. One of the two films can be a deep-drawn film, and the other film can be a cover film. Instead of one chamber, two chambers, a first and a second chamber, can also be provided for separate accommodation of different substances, which are to be brought into connection with one another by way of a passage region that can be selectively opened.

In use, a connection with the second chamber is first produced by means of pressure onto the first chamber, in order to mix the two components with one another. However, mixing is not entirely satisfactory. Then the part of the device that contains the empty chamber is bent onto the second chamber in such a manner that the chambers lie on one another on the cover film, and after pressure onto the second chamber, the brush is wetted with the liquid mixture.

This device also has the disadvantage that the second chamber must be so large that it can accommodate the volume of both components. This causes either that the component in the second chamber suffers because it is exposed to air during storage, or that the free space above the second component must be filled with an inert gas, or evacuated, and this increases the production expense. In order for the bending process to take place at the right location, the two films are pulled in at the sides, in the region between the two chambers. Because of the arrangement of the two chambers in series, they have to be pressed out one after the other. In all the alternatives, nothing is said about the way the components are filled in. Because of the use of a brush as the application instrument, handling during application of the substance capable of flow onto the application site is also only possible with two hands. Furthermore, the production and storage of the device are complicated, because of the brush that is required for applying the liquid mixture.

An analysis method and a device for implementing this method are known from DE 100 34 647 C1 (3M Espe). For this purpose, the device has a pocket, an applicator, and at least one chamber containing an indicator substances and, if necessary, another chamber containing a buffer substance, whereby the first chamber can be connected with the pocket, and the second chamber, if it is present, can be connected with the first chamber and/or the pocket by way of a passage region that can be selectively opened. Also, several chambers can be present, which are connected by way of passage regions that can be selectively opened, in such a manner that all of the substances contained in them can be transferred to the pocket in serial and/or parallel manner; this necessarily is done using two hands.

Here again, the need for a special applicator has a detrimental effect on the production process, the storage, with regard to the space required, and the handling, which again, as mentioned, can only take place using two hands.

A device for storing and dispensing a composition capable of flow is disclosed by DE 100 56 212 A1 (3M Espe), having a first and a second film, a dispensing region, a first chamber containing a first substance, and a second chamber containing a second substance, whereby the chambers can be connected with one another by way of a passage region that can be selectively opened, at least one of the films in the region of the chambers is deep-drawn, and at least one of the films in the region of the second chamber is preformed or can be preformed in such a manner that after activation of the device by opening the passage region, the first substance can be completely transferred to the second chamber, thereby increasing the volume of the latter. In this way, storage and dispensing even of larger amounts of substance is supposed to be made possible, without any detrimental effect on the result of mixing.

The configuration of the second chamber in such a manner that its volume can be increased causes the production expense to be increased, and requires the use of a film that can be deformed or stretched under pressure onto the second chamber.

A dental bleaching system that merely serves for storage is known from U.S. Pat. No. 5,240,415 A (Haynie), in which heated silicic acid is supposed to be used as the basis for the production of a paste with a hydrogen peroxide solution. In this connection, the paste serves as a non-reactive carrier, in order to control the application of the hydrogen peroxide solution onto a tooth surface. The silicic acid is at first contained, by itself, in a predetermined amount, in a mixing chamber, while the hydrogen peroxide solution, in a predetermined volume, is accommodated in an ampoule. Both of them, the silicic acid and the ampoule, are accommodated in depressions, which are open towards the top, of a corresponding deep-drawn carrier, which depressions are covered with a protective film for storage.

A plastic packaging for storing and dispensing active material is known from U.S. Pat. No. 4,534,509 (Holzner), which has several compartments that are intended to accommodate liquid, solid, or gel-like material. The compartments are formed by connecting two flexible polymer films, so that at least one sealed storage compartment is present, which is impermeable for the active material, as well as a sealed accommodation compartment. At least one of the edges of the storage compartment is formed by a system that consists of an inner foam material layer and adheres to leak-proof, flexible polymer films at its two outside surfaces. External pressure onto one of the compartments causes the foam material layer to tear open, without damaging the polymer films, so that it is possible to empty the storage compartment into the accommodation compartment, without exposing the active substance to the environment. This plastic packaging is particularly useful for ready-to-use mixtures of different components, immediately before their use. It is not stated how the storage compartment is filled and the active mixture is dispensed from the packaging.

A packaging for liquid fill material, consisting of a deep-drawn part and a cover film that tightly covers the deep-drawn part from the top, is known from DE 31 22 237 A1 (Klocke), in which a liquid fill material as well as an insert part for dispensing the liquid are located in the space between the deep-drawn part and the cover film. The packaging has a planned breakage point that is placed in such a manner that when one part of the packaging is broken off the other part, the insert part is exposed, so that liquid can be dispensed through a passage channel from the space for liquid, through the insert part. This packaging is particularly intended for use as disposable packaging or also for samples of goods. By means of a suitable configuration of the insert part (brush, sponge, eyedropper, plug, etc.), the method and the speed of dispensing the liquid can be determined. This packaging, too, is complicated in its production, and requires operation with two hands.

A single-dose disposable dispensing device for several materials is known from EP 0 770 021 B1 (FIG. 16/17) (Centrix), which has a flat container element and a complementary cover element, an applicator depression, which is formed in the flat container element, and an open end, as well as an applicator that is arranged in the applicator depression and part of which extends beyond the open end of the applicator depression. In this connection, a holder device is provided, which belongs to the applicator depression, an articulation that connects the cover element with the flat container element, at least two material depressions that are formed in the flat container element, a depression gasket that is formed in the flat container element and surrounds each of the material depressions, a complementary depression gasket that is formed in the cover element for each of the material depressions, whereby the complementary depression gaskets come into engagement with the corresponding depression gaskets, in order to seal off the material that is filled into the material depressions.

This dispensing device, which is intended for medications, is also complicated in its production and difficult to handle, particularly if two components are supposed to be mixed, and these are to be brought to a mixing region of the flat container with the applicator, and mixed there.

A thin, small plastic packaging, also for liquid substances, having a metering opening that is made in it, is also known from DE 33 10 215 A1 (Flier), which is characterized in that the fill substance is packaged in an edge-sealed, i.e. edge-glued plastic bag, the lower wall of which consists of thick material, but the upper wall of which consists of a thinner material. In this connection, the thinner side of the bag is bonded or glued to a thicker film strip on its bonding or gluing edge; at the same time, a cut-profiled rod is placed between the thinner side of the bag and the film strip that lies above it, resting freely, the other end of which is rigidly connected with the film strip that continues further, so that when the pull piece of the film, which lies between the bag and the separating cut-outs that form the tear or separation location, is pulled, this end is pulled out of the part that separates, and thereby cuts the thin-walled side of the bag open, under the pressure of the film, as it passes over it, and creates an opening in the bond or glue seam between the film and the bag, at the tear or separation location, from which the fill content is caused to flow out, in metered manner, by means of pressure on the bag, and this opening closes again when the pressure is relieved, because of the material elasticity of the film and the bag.

WO 01/46037 A1 (Espe Dental) shows and describes a device for storing and dispensing a substance capable of flow, made of a top and bottom film, which form at least one chamber, a dispensing region, and a passage region that can be selectively opened and connects the chamber and the dispensing region, whereby the films are peelable in the passage region and are firmly bonded to one another in the other regions, and whereby an enlargement of the surface can be achieved at least in a partial region of the dispensing region, by means of forming waves in the top and/or bottom film, with a progression of the wave valleys along the flow direction. In this way, it is supposed to be possible to dispense even larger amounts of substance in targeted manner, simply, and without spilling, without any additional aids. In one embodiment of the device, two chambers arranged in parallel, separated from one another by a partition wall, are provided, which open into a passage region, parallel to one another, in the region of a chamber shoulder. Each of the chambers is intended to accommodate a substance capable of flow, and both chambers are separated from the dispensing region by means of a peelably sealed passage region. Furthermore, the peelably sealed passage region also separates the chambers from one another. While the two chambers have no connection with one another in the sealed state of the device, because of the sealed passage region, mixing the two substances located in the chambers is possible in the jointly provided dispensing region, after the passage region has been opened. Weakening of the passage region to facilitate opening is done by twisting the chambers in the region of the chamber shoulder, against a wing in the longitudinal direction of the dispensing region. After having been twisted back into the initial position, the passage region is sufficiently weakened so that even slight pressure onto one or both of the chambers can bring about opening of the passage region and therefore a connection between the chamber or chambers, in each instance, and the dispensing region. Furthermore, it is possible, by means of reduced pressure on one of the chambers, to dispense only part of the amount of substance contained in the chamber. In this way, it is also supposed to be possible to influence the mixture ratio of the two substances to be dispensed, but this involves difficult handling. In particular, this device also requires two-hand operation.

Furthermore, a container for separate storage of at least two products is known from DE 37 26 876 A1, which has two compartments separated from one another, and a film that seals them. In one of the compartments, which is additionally sealed by another inner film that is spaced apart from the first film, a ring-shaped insert is provided, which is provided with a row of teeth on its side facing the film. To open the compartment, pressure is exerted on the insert by way of the container wall, so that the teeth of the ring cut through the inner film of the ring, and the product can be dispensed into the second compartment. Several passage openings are provided in the insert, so that a liquid accommodated in the compartment can flow into the second compartment, where it is mixed with the base product, also through the ring-shaped insert. After the first film, which covers the entire container, is pulled off, the ready-mixed product can be removed from the second container, for example by using an applicator. Also with this container, it is not possible to precisely meter the amount of fluid transferred from the first compartment into the second compartment.

SUMMARY OF THE INVENTION

The present invention is based on the task of proposing a device for storing and dispensing viscous substances, as functional packaging, which is easy to produce, can be stored in space-saving manner, and is easy to operate, in which even small amounts of substances can be safely stored, mixed with one another in the correct mixing ratio as needed, and easily applied, for example in the dental sector.

This task can be accomplished, according to the invention, according to a first embodiment, for example, by means of a device for storing and dispensing viscous substances, which are to be mixed from at least two components for use, having a film-like carrier, for example, in which at least three or four depressions are formed, for example arranged next to one another in a row, which are open towards the top, at first, so that one of the components, in each instance, can be introduced from the top into one of two center depressions, in each instance, i.e. depressions that are adjacent and are arranged at essentially the same distance from a bending line, and afterwards, the two center depressions can be sealed with a cover film, towards the outside, forming a chamber, in each instance, in such a manner that between each center chamber and at least one adjacent outer depression, a connection channel that opens towards at least one outer depression when pressure is applied to the center chamber, in each instance, by way of a planned breakage point, remains, and in this way, the components located in the two center chambers can be mixed in a third chamber and/or already in the connection channels that are connected with one another, which third chamber is formed by folding the two carrier segments that are connected with one another by way of the bending line onto one another, by the at least one or the two outer depressions that thereby cover each other, upside down, as a result, whereby after the two carrier segments have been folded on top of one another, the third chamber can also be sealed towards the outside, for example by heat-sealing or gluing, specifically preferably in such a manner that between the third chamber and the edge of the carrier, a dispensing channel that opens when pressure is exerted on the third chamber containing the at least two components, by way of a planned breakage point, remains, and in this way, the viscous substance that is mixed from the two components and exits from the dispensing channel can be applied to the application site.

The device according to the invention, which is compact because it is relatively short, has the particular advantage that the components can be simultaneously and jointly expelled from the two center chambers, once they have been folded onto one another, into the third chamber, by applying pressure, for example between the thumb and index finger of a single hand, and thus extremely good mixing of the two components takes place, with simple handling, particularly if mixing already takes place in the connection channels.

The device according to the invention can be used for viscous substances whose individual components are also viscous, but not all of them have to be viscous. Thus, for example, viscous components can be accommodated in the two center chambers, in each instance, and a powder-form component can be accommodated in the third chamber, so that when they are mixed, a viscous substance is formed, in total, which can be expelled from the dispensing channel.

The film-type carrier can consist of a self-supporting, thermoplastic, deep-drawn part, while the cover film can be a relatively thin, flat material, which can be easily bonded or glued to the carrier, forming a hermetic seal. The planned breakage points can be created, for example, in that the cover film can be removed from the carrier, in their region, more easily than the connection between the cover film and the carrier can be broken in the edge region.

The device according to the invention is simple to produce, in that the corresponding components are inserted into the center depressions of the carrier, which are open towards the top, before the cover film is applied. The device according to the invention permits precise metering of the components during mixing of the viscous substance, whereby the third chamber, in which the components are supposed to be mixed, has or assumes such a volume that all of the components to be mixed can be accommodated in it. The two center chambers, in contrast, only need to have such a volume capacity that they can accommodate an individual component, in each instance.

Another advantage of the device according to the invention is that the device itself can be used directly as an applicator.

It is evident that several, e.g. powder-form and/or liquid, components can be stored for use in one of the chambers, as long as they do not react with one another. Also, several center chambers arranged next to one another can be linked with one another and/or with one or more third chambers, in similar manner.

It is easily understood that the embodiment explained above can be simply modified in that the carrier consists not of two carrier segments connected by way of a bending line, but rather the carrier segments are separated, at least at first, and after introduction of the components into one chamber, in each instance, and closure by means of one each or a common cover film, the two carrier segments can be placed onto one another, upside down, so that the two first chambers filled with component, on the one hand, and, if each carrier segment has an additional depression, the two additional, empty depressions, which then form the mixing chamber, are brought into coverage with one another. If only one of the carrier segments has an additional depression, then this alone forms the mixing chamber when the carrier segments are placed on top of one another.

In the embodiment last described, the cover films with which the two depressions filled with component are sealed, forming chambers, can be configured as a single film with which the two carrier segments, which are at first separate from one another, can be connected with one another, and which film then forms a type of film hinge by way of which the two carrier segments can be flipped on top of one another.

In all the embodiments mentioned above, the two cover films or, in the case of a one-piece configuration, the film segments that seal off the two first chambers, lie directly against one another in the position in which they are folded, placed, or flipped onto one another.

In all the aforementioned embodiments, it is furthermore advantageous if the two first chambers lie essentially with the same coverage relative to one another after the two carrier segments have been folded, placed, or flipped onto one another, as do the two depressions, if applicable, that jointly form a mixing chamber, in order to assure a high level of functioning capacity. At least the one depression should completely cover the one that lies opposite it.

It is furthermore advantageous if the planned breakage points permit flow of the components, in each instance, in only one direction of the dispensing channel. In this way, reflux of the individual components is reliably prevented.

While the depressions formed in the carrier are normally configured in calotte shape, emptying the components in the direction of the mixing chamber when pressure is applied and, in particular, complete emptying of the storage chambers, can be facilitated, and reflux of the components or the mixture of them can be prevented, if an insert or inserts of an essentially non-resilient material having a level or slanted surface is/are arranged in at least one of, preferably two of the depressions assigned to one another, into which one of the components is introduced and stored, or in which the components are mixed.

In this connection, the space between two inserts assigned to one another can advantageously run conically, whereby the greater distance of the surfaces of the inserts lies on the side of the connection channel to the mixing chamber or on the side of the dispensing channel to the edge of the carrier, in each instance. After the first chambers (supply chambers) or the third chamber (mixing chamber) have/has been completely compressed, the surfaces of the inserts then essentially lie parallel to one another, so that it is assured that the substances present in the chamber, in each instance, are completely pressed out.

If the inserts, particularly those arranged in the mixing chamber, can be set in steps relative to one another, very precise metering is possible when dispensing the mixture onto the application site.

Since all of the chambers fitted with such inserts permit precise metering, this idea of the invention by itself is also suitable for dispensing of single-component systems.

Mixing of the individual components in the common connection channel and/or the common dispensing channel can be improved in that a mixing device for mixing the components that flow through there, during and because of their transport, is provided in the channels themselves, in each instance. Such a mixing device can be a static mixer, an inserted mixer helix, a Kennex mixer, or a labyrinth mixer.

In order to be able to apply the viscous substance to the application site in simple and targeted manner after the individual components have been mixed, it is furthermore proposed that the dispensing channel is configured to be narrowed towards its exit end, in the form of a cannula or funnel, and/or that the chamber that accommodates the mixture of the components is configured in phial-like manner as an applicator, in order to achieve a high level of metering accuracy and application reliability.

In this connection, it is furthermore advantageous if the walls of the phial-like applicator are configured to be elastically resilient, at least in certain regions. In this way, a type of pumping effect can be achieved, in order to guarantee a high level of metering accuracy.

The task on which the invention is based can also be accomplished according to another embodiment, for example also by a device for storing and dispensing viscous substances, which has a carrier, for example a film-like carrier, in which at least one depression on one side is formed, so that at least one substance can be introduced into the at least one depression, and afterwards closed off towards the outside with a cover film, forming at least one chamber, that a dispensing channel that opens by way of a planned breakage point remains when pressure is applied to at least one of the chambers, and in this way, viscous substance that exits from the dispensing channel can be applied to an application site, whereby an insert made of essentially stiff, non-resilient material is arranged in the chamber, and/or at least one layer of essentially stiff, non-resilient material is arranged opposite the at least one depression. In this connection, the insert can have a level, stepped, curved, or slanted surface for dispensing the viscous substance. Emptying the substance from the normally calotte-shaped depression can be facilitated by providing the insert or the stiff layer, whereby at the same time, reflux of the substance is prevented. When the depression is squeezed together between two fingers, it is dented in locally, whereby the surface of the insert is brought closer to the cover film. The use of an insert in the depression consequently ensures that the chamber can be completely emptied by applying pressure onto the insert arranged in the depression. The stiff layer that is provided as an alternative to or in addition to the insert serves as a counter-bearing for the pressure applied to the depression, and thereby also facilitates emptying of the chamber.

Preferably, the insert is attached in the chamber in such a manner, for example glued to it, that the surface of the insert, i.e. the side facing the cover film, forms an acute angle with it. For this purpose, the insert can have a slanted surface or be arranged at a slant in the depression. The greater distance of the surface of the insert from the cover film thereby lies on the side of the dispensing channel, so that in order to empty the chamber, the surface of the insert must be brought into essentially parallel alignment with the cover film. In this connection, it is assured, at the same time, that the insert does not hinder dispensing of the substance, for example by blocking the dispensing channel.

Very precise metering during dispensing of the substance onto the application site is made possible in that the surface of the insert has one or more steps that run crosswise to the direction of the dispensing channel. The surface of the insert can thereby be set, step by step, in the direction towards the cover film. By means of a suitable selection of the step size, the amount of substance dispensed from the chamber in each individual dispensing step can be adjusted in this manner. Thus, a constant metering amount of the substance with each step can be achieved in that the length of the steps decreases as a function of their distance from the cover film.

In the same manner, the insert can be brought closer to the cover film, in defined manner, step by step, if the insert has an engagement rod. Such an engagement rod can be, for example, a rod having engagement elements, about which the insert can be pivoted in defined steps. However, the engagement rod can also be configured as a pin that projects from the surface of a first insert, having engagement elements on its circumference, which engages into a corresponding depression of a second insert that lies opposite an insert, for example the first insert, in order to bring the two inserts closer to one another, step by step. As an alternative to this, it is also possible to provide projections and recesses in two opposite inserts, in each instance, which lock into one another or engage into one another as the two inserts come closer to one another.

In order to store a larger amount of an individual substance or several different substances in the device according to the invention, several depressions for forming chambers can be provided in the carrier, next to one another or one behind the other. In this connection, the chambers can be connected with one another by way of connection channels that have a planned breakage point that opens to the chamber when pressure is exerted. In the same manner, the individual chambers can be connected with a common dispensing channel by way of one or more connection channels. Furthermore, it is also possible to dispense the substances simultaneously or one after the other, by means of dispensing channels that lie parallel to one another. The chambers are therefore arranged either for parallel (simultaneous) or serial (with a time off-set) dispensing of substances. In the case of a serial arrangement of two chambers, each chamber is preferably sealed by a cover film, so that when a first substance is dispensed, it does not mix with a second substance accommodated in the second chamber. Fundamentally, individual chambers or all the chambers can be sealed by means of a common cover film or separate segments of a cover film. If only some chambers are sealed with a cover film, the other chambers can be sealed in that this cover film is flipped or folded onto the uncovered chambers, forming a seal.

According to a preferred embodiment of the invention, it is provided that by bending the carrier, depressions that are assigned to one another are folded onto one another in such a manner that the cover films that cover the chambers, or the depressions in the carrier, lie essentially on top of one another. The channels for dispensing the substances from the chambers also lie on top of one another, if applicable, after the chambers have been folded onto one another, and can open into a common mixer or dispensing channel. In this manner, the chambers formed by the depressions assigned to one another can be emptied simultaneously, in that the chambers are pressed against one another. Thus, either a larger amount of a single substance, or different substances simultaneously, can be emptied out of the device by pressing once on the two chambers of the device according to the invention.

If the cover film that seals the chambers is formed of a stiff material, the pressure exerted when dispensing a substance from one chamber is not transferred to the other chamber when two chambers are folded onto one another. By means of the stiff material that acts as a counter-bearing, the chambers open almost at the same time, if pressure is exerted on them by the thumb and index finger, for example. The same effect can also be achieved in that a rigid plate is placed between two cover films, which can be elastic, which plate is supported on the carrier. In this connection, it is not absolutely necessary for an insert to be provided in one or both chambers.

It is preferred if, independent of the characteristics described above, a mixing device that can be set on and/or inserted is provided in or on the dispensing channel, or an applicator for dispensing and applying the substances is provided. Such a mixing device can, on the one hand, bring about uniform and thorough mixing of two different substances accommodated in the device, or also serve to achieve a desired consistency of an individual substance.

In a further development of the idea of the invention, it is provided to equip the mixing device or the applicator with a region that can be set onto the dispensing channel, e.g. a tube-shaped region, on the inside of which two radial grooves that lie opposite one another are made. In this connection, the dimensions of the grooves correspond to those of the carrier. In this manner, the regions of the carrier that have been folded onto one another, for example, can be jointly introduced into the grooves of the mixing device and thereby preferably held together in a press fit. In this way, the mixing device can be connected with the device for storing and dispensing viscous substances, essentially sealed with regard to liquids.

A particularly good mixing result can be achieved if the mixing device has a mixer helix. Such a mixing device can furthermore be produced in series production, in inexpensive manner. Alternatively, the mixing helix or an applicator, such as a brush, an application tube, or the like, can also be provided directly in the dispensing channel.

A simple solution, in terms of production technology, for the device according to the invention is achieved, in particular, if the carrier and the cover film are configured in strip shape, whereby the carrier is preferably made of a thermoplastic material, if necessary, and the cover film is made of an aluminum laminate film.

In this connection, several carriers and/or cover films can be connected with one another in chain-like manner, releasably, e.g. so that they can be torn off on the basis of weakening lines and/or perforations, perhaps by way of film-like articulations, so that several storage and dispensing devices according to the invention that are individually connected with one another in a line can be laid together in space-saving manner, for example rolled up into a roll or laid together in meanders.

BRIEF DESCRIPTION OF THE DRAWINGS

Other goals, characteristics, advantages, and application possibilities of the invention are evident from the following description of exemplary embodiments, using the drawing. In this connection, all the characteristics described and/or shown in the figures form the object of the invention, by themselves or in any desired combination, also independent of their summary in individual claims or their antecedents.

The drawing schematically shows.

DETAILED DESCRIPTION OF PREFERRED EMBODIMENTS

Figure 1:
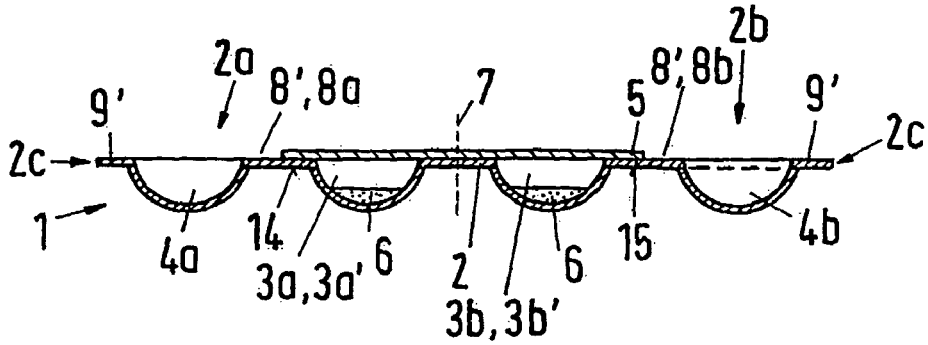
FIG. 1 in vertical, longitudinal section, a storage and dispensing device that contains the invention, in a first embodiment of the invention, FIG. 2 in vertical, longitudinal section, the storage and dispensing device according to FIG. 1, after the two carrier segments that border on a center bending line have been folded onto one another, FIG. 3 also in vertical, longitudinal section, a second embodiment of a storage and dispensing device according to the invention, in which the mixing and dispensing chamber is configured as a phial-like applicator having elastically resilient walls, FIG. 4 a device according to a third embodiment of the invention, having a single chamber, FIG. 5 a device according to a fourth embodiment of the invention, having two chambers, FIG. 6 a device according to a fifth embodiment of the invention, having two chambers and a mixing device, FIG. 7 a device according to a sixth embodiment of the invention, having two chambers and a mixing device.
Figure 2:
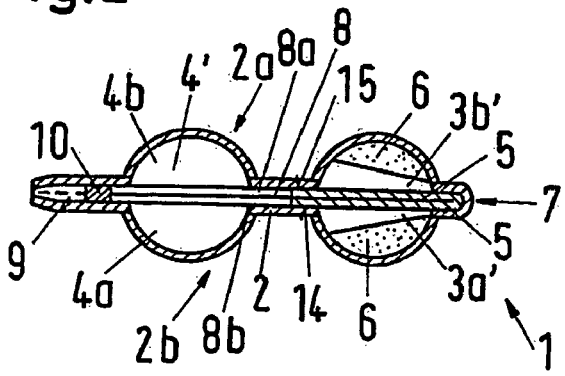

In the embodiment of a storage and dispensing device 1 illustrated in FIGS. 1 and 2, a carrier 2 has four depressions 3*a*, 3*b*; 4*a*, 4*b* at first arranged in series, specifically with mirror symmetry relative to a bending line 7. In the production of the storage and dispensing device 1, the components to be mixed with one another are introduced into the two center depressions 3*a*,3*b*. Also, only these center depressions 3*a*, 3*b* are closed off with a film 5, to form two center chambers 3*a*', 3*b*'. Closing takes place in such a manner that in each instance, one channel half 8' to the adjacent depressions 4*a*, 4*b* remains free, with the interposition of a planned breakage point 14 and 15, respectively.

Between the two center chambers 3*a*', 3*b*', the strip-like carrier 2 has the bending line 7 that runs crosswise to the longitudinal expanse of the carrier 2, as already mentioned. By way of this line, the right carrier segment 2*b* in FIG. 1 can be folded onto the left carrier segment 2*a* in FIG. 1, so that it assumes a position as shown in FIG. 2, in which the two halves of the common cover film 5 of the two depressions 3*a*, 3*b* lie on one another. In this connection, the chambers 3*a*', 3*b*', on the one hand, and the depressions 4*a*, 4*b* are not only arranged at the same distance from the bending line 7, but also configured and dimensioned in such a manner that they practically completely cover one another, according to FIG. 2, or at least one depression completely covers the other completely. When they are folded onto one another, the depressions 4*a*, 4*b* form a third chamber 4'. In the position shown in FIG. 2, the two carrier segments 2*a*, 2*b* are then connected with one another at their edges, or the two halves of the cover film 5 are connected with one another, for example glued or bonded together, in such a manner that the two channel halves 8' form a common channel 8, and a dispensing channel 9 follows on the opposite side of the chamber 4', which leads to the outside but is at first closed off by way of a planned breakage point 10. Other than that, the chambers 3*a*', 3*b*', 4' are hermetically sealed.

In the case of the device described, pressure can be exerted jointly on the two chambers 3*a*' and 3*b*' that lie on top of one another, between the thumb and index finger of one hand, so that the components contained in them are transferred simultaneously into the chamber 4', by way of the planned breakage points 14, 15 that open, and the channel 8, and are mixed there.

It is evident that instead of the planned breakage points 14, 15, or in addition to them, another planned breakage point (not shown) can be provided in the common channel 8, which opens when pressure is exerted on the two chambers 3*a*', 3*b*'.

Both in the connection channel 8 and in the dispensing channel 9, a mixing device can additionally be provided. The size of the chamber 4' is dimensioned in such a manner, or can be expanded in such a manner, that it can accommodate all the components from the chambers 3*a*' and 3*b*'. Once all the components are located in the chamber 4', pressure can be exerted between the thumb and index finger of one hand, in the same manner as described above, so that the planned breakage point 10 opens and the ready-to-use viscous substance can be expelled from the dispensing channel 9, directly onto the application site.

In order to achieve the result that the components in the chambers 3*a*', 3*b*' are transferred into the chamber 4' as completely as possible, inserts 6 having level surfaces that run conically relative to one another are arranged in the depressions 3*a* and 3*b*, in accordance with the representation in FIG. 2, in such a manner that the space between the surfaces widens towards the channel 8. The surfaces pivot towards one another under the common pressure on the chambers 3*a*', 3*b*', so that they finally come to rest against the side of the film 5 that has also been folded over, in each instance.

In FIG. 1, it is indicated with a broken line that shows the depression 4*b*, that this depression can also be eliminated. Then the depression 4*a* by itself forms the mixing chamber 4' when the carrier segments 2*a*, 2*b* are folded onto one another.

Figure 3:
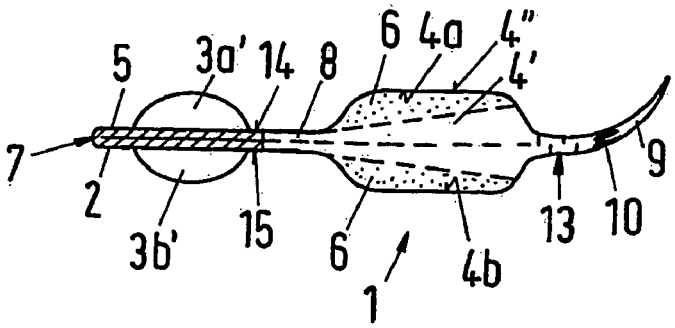

The embodiment shown in FIG. 3 corresponds to the one shown in FIGS. 1 and 2, to a great extent. One difference is, however, that on the one hand, the dispensing channel 9 is configured as a cannula-like applicator 4", narrowing towards its exit end, and that a mixing device 13 in the form of a baffle plate is shown within the dispensing channel 9. The chamber 4', in which inserts 6 according to FIG. 2 can be arranged, thereby forms a type of phial that can be used to precisely meter the application of the multi-component mixture. The walls of the applicator 4" can consist of elastically resilient material, so that a pumping effect can be achieved.

It is, of course, also possible to apply the multi-component mixture using an applicator, for example a brush-like applicator, arranged in the dispensing channel 9 or subsequent to it, to the application site. For this case, the applicator should be sealed into a film or covered by a cap, for hygiene reasons. Only when the device according to the invention is put into use is this protective cover torn open, for example by way of a perforation.

Figure 4:
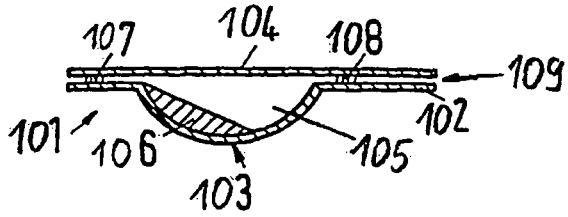

The device 101 for storing and dispensing a viscous substance, not shown in the figures, shown in vertical, longitudinal section in FIG. 4, is formed by a first film-like carrier 102 that has a depression 103 that is open towards the top in the figure. A cover film 104 is applied to the carrier 102, forming a seal for liquids, so that the depression 103 in the carrier 102, together with the cover film 104, forms a sealed chamber 105.

An insert 106 made of an essentially non-resilient material is attached in the depression 103 of the carrier 102, for example by means of gluing. In this connection, the level surface of the insert 106 is aligned at a slant to the cover film 104, and forms an acute angle with it.

The hermetical connection between the cover film 104 and the carrier 102 takes place, for example, by means of bonding and gluing in the edge region of the carrier and the film, as indicated by reference number 107. On the right side in the figure, the connection region between the cover film 104 and the carrier 102 is provided with a planned breakage point 108, in such a manner that the latter opens under increased interior pressure in the chamber 105, and releases a dispensing channel 109 between the carrier and the cover film. This can take place, for example, in the case of the device 101 described, in that the depression 103 of the carrier 102 and the region of the cover film 104 that lies opposite the depression 103 are both pressed together between the thumb and forefinger of one hand, so that the insert 106 is pressed against the cover film 104. In this way, the pressure of the viscous substance contained in the chamber 105 increases in such a manner that the planned breakage point 108 is pushed open and the substance can exit from the dispensing channel 109. In this connection, the insert 106 has the effect that the substance contained in the chamber 105 is dispensed through the dispensing channel 109 as completely as possible, whereby the insert 106 pivots into a position in which its surface is essentially oriented parallel to the cover film 104, while the chamber 105 empties.

Figure 5:
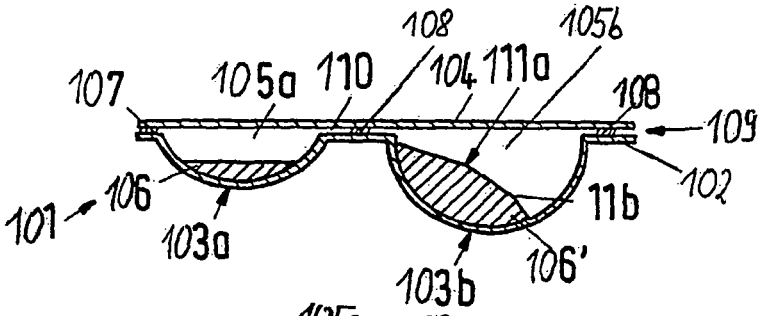

In the case of the device 101 shown schematically in vertical, longitudinal section in FIG. 5, two depressions 103*a* and 103*b* of different sizes are formed in the carrier 102, which form a first chamber 105*a* and a second chamber 105*b* together with the cover film 104 that closes off both depressions 103*a* and 103*b*. The cover film 104 is hermetically connected with the carrier 102, by means of a seal 107, whereby a planned breakage point 108 is provided in the connection region between the cover film 104 and the carrier 102, in the region of the dispensing channel 109. The two chambers 105*a* and 105*b* are connected with one another by way of a connection channel 110, which is formed between the cover film 104 and the carrier 102. Here, the connection channel 110 can also be closed off with a planned breakage point 108, which can be broken open by applying pressure onto the substances, not shown in the figure, that are contained in the chambers 105*a* and 105*b*.

In the right chamber 105*b* in the figure, an insert 106' is arranged, which is provided with steps 111*a* and 111*b*, in such a manner that the otherwise level surface of the insert 106' runs at different angles to the cover film 104. An insert 106, whose level surface runs essentially parallel to the cover film 104, is placed in the depression 103*a* that forms the chamber 105*a*. A substance contained in the chamber 105*a*, which can be different from or the same as the substance contained in the chamber 105*b*, can be transferred to the chamber 105*b* in the manner described above, in that pressure is exerted on the depression 103*a* and the region of the cover film 104 that lies opposite the depression 103*a*, for example by way of the thumb and index finger of one hand. To dispense substances from the chamber 105*b*, pressure is exerted on the depression 103*b* and the region of the cover film 104 that lies opposite the depression 103*b*, in the same manner. In this connection, the insert 106' is at first pivoted against the cover film 104 only so far that the first step 111*a* rests against the cover film 104. In this way, an amount of the substance contained in the chamber 105*b* that can be predetermined as a function of the configuration of the steps can be dispensed. When the depression 103*b* is compressed further, against the cover film 104, the insert 106' pivots further in the direction towards the cover film 104, until at first the second step 111*b*, and then also the right region of the surface of the insert 106' in the figure rest against the cover film 104, and thus the chamber 105*b* is emptied, to the greatest possible extent. The substances that are mixed with one another are jointly dispensed from the device 101 by way of the dispensing channel 109, in this connection, whereby the planned breakage point 108 is broken open.

Figure 6:
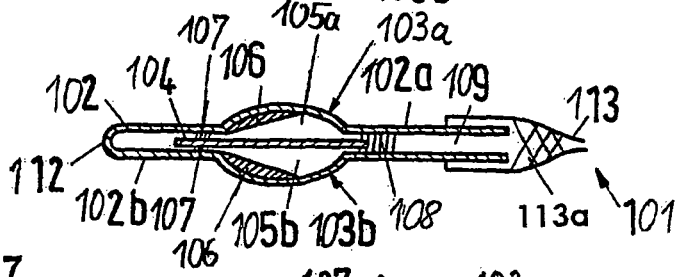

Also in the embodiment shown in FIG. 6, two depressions 103*a* and 103*b* having essentially the same size and shape are provided in the film-like carrier 102. On a bending line 112, that is weakened, for example, two regions 102*a* and 102*b* of the carrier 102 can be folded onto one another, in such a manner that the depressions 103*a* and 103*b* essentially lie opposite one another. In this connection, one or both of the depressions 103*a* and 103*b* can be closed off by means of preferably two cover films, or by two segments of a common cover film that are folded onto one another or, as shown in the figure, by means of a single, common cover film 104, in order to form two chambers 105*a* and 105*b* that lie opposite one another. On the right side of the device 101 in the figure, the two regions 102*a* and 102*b* form a dispensing channel 109 between them, which is closed off by means of a planned breakage point 108. Inserts 106 are arranged in the depressions 103*a* and 103*b*, in each instance, in such a manner that their surfaces form an acute angle to one another and to the cover film 104. In this connection, the surfaces of the inserts 106 are farther apart from one another in the direction towards the dispensing channel 109. In this manner, the substances contained in the chambers 105*a* and 105*b* can be dispensed from the device 101 at the same time, through the dispensing channel 109, if pressure is exerted on the two depressions 103*a* and 103*b* in the carrier 102 that lie opposite one another. In order to achieve thorough mixing of the different substances, for example, of the chambers 105*a* and 105*b*, a mixing device 113 having an internal mixing helix 113*a* is set onto the dispensing channel 109. In this connection, the mixing device serves, at the same time, as an applicator for applying the substance(s). Alternatively, the mixing helix can also be inserted into an applicator, which can also have any configuration different from the figure, or directly into the dispensing channel 109.

Figure 7:
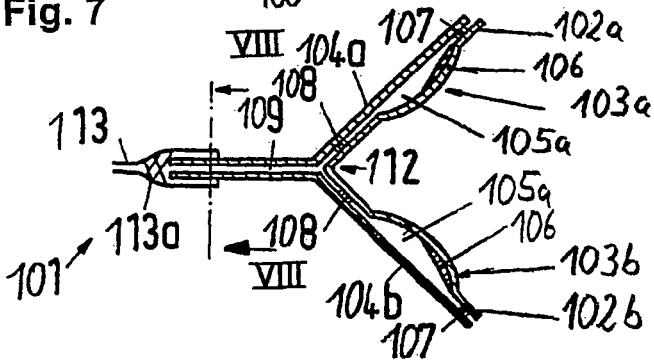

FIG. 7 schematically shows a further embodiment of the device 101 for storing and dispensing viscous substances, in vertical longitudinal section, in which two depressions 103*a* and 103*b* having essentially the same shape and size are formed in the carrier 102. Two carrier segments 102*a* and 102*b* are folded onto one another along a bending line 112. The depressions 103*a* and 103*b* are each hermetically sealed by way of a cover film 104*a* or 4*b*, by means of a seal 107, so that two chambers 105*a* and 105*b*, respectively, form in the depressions 103*a* and 103*b*. Between the cover films 104*a* and 104*b* and the carrier 102, a dispensing channel 109 that runs from the chambers 105*a* and 105*b*, respectively, in the direction towards the bending line 112, is formed, which is closed off by means of planned breakage points 108. The cover films 104*a* and 104*b* abut one another in the region of the bending line 112, in such a manner that the two dispensing channels of the chambers 105*a* and 105*b* are continued to the left in the figure, between the cover films 104*a* and 104*b*. A mixing device 113 (applicator) having a mixing helix 113*a* is laid into or set onto the dispensing channel 109 and the cover films 104*a* and 104*b*.

If the carrier segments 102*a* and 102*b* are now pivoted further towards one another, so that the depressions 103*a* and 103*b* in which an insert 106 is provided, in each instance, abut one another, the planned breakage points 108 in the dispensing channel 109 are broken open by means of the pressure that builds up in the chambers 105*a* and 105*b*, so that the substances contained in the chambers 105*a* and 105*b* are dispensed from the device 101 through the dispensing channel 109 and the mixing device 113. The substances dispensed from the chambers 105*a* and 105*b*, which can be identical or different, are mixed with one another in the mixing helix 113*a* of the mixing device 113.

Figure 8:
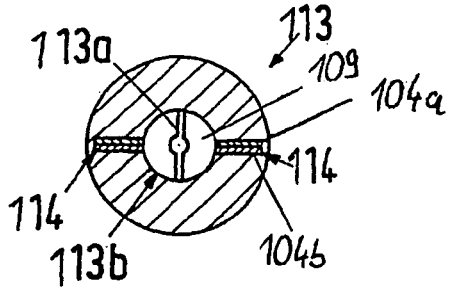
FIG. 8 is a sectional view of a mixing device taken along line VIII-VIII in FIG. 7, FIG. 9 a device according to a seventh embodiment of the invention, having four chambers and an applicator, FIG. 10 a side view of the device according to FIG. 9.

The mixing device 113, as is shown schematically in the sectional view shown on a larger scale in FIG. 8, is formed by a cylindrical body having a central passage bore 113*b*, in which the mixing helix 113*a* is also accommodated. Furthermore, two opposite radial grooves 114 are provided in the mixing device 113, which extend from the edge of the bore 113*b* to the vicinity of the outside wall of the mixing device. In this connection, the dimensions of the grooves 114 and the passage bore 113*b* are selected in such a manner that two segments of the carrier 102 or of the cover film 104 that lie on top of one another, in each instance, are held in the passage bore 113*b*, preferably forming a seal. In this manner, it is avoided that the substances dispensed from the chambers 105*a* and 105*b* flow out at the end of the mixing device 113 that faces the bending line 112. Instead, the entire volume of the substances dispensed from the two chambers is passed directly to the mixing helix 113*a*, by way of the dispensing channel 109 and, after having been mixed together, dispensed at the tip of the mixing device 113 that faces away from the bending line 112.

The configuration and arrangement of the inserts 106 and 106', respectively, in the depressions 103, 103*a* or 103*b* of the device 101, can be adapted as a function of the requirements concerning dispensing of the substances contained in the chambers 105, 105*a*, or 105*b*. Thus it is possible, for example, to align all the inserts 106 with their surface at a slant or parallel to the cover film 104. Furthermore, one or several steps 111 can also be provided in the insert 106', in order to dispense defined amounts of the viscous substances from the chambers.

Figure 10:
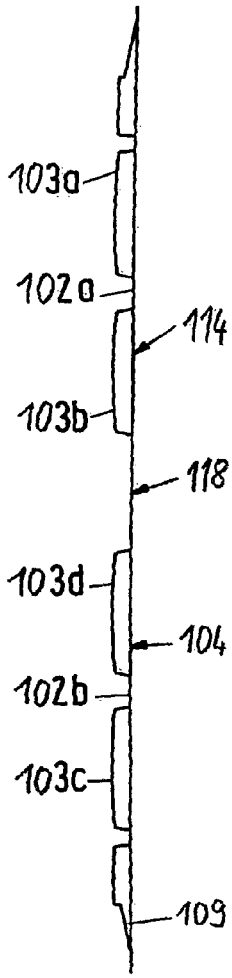
Figure 9:
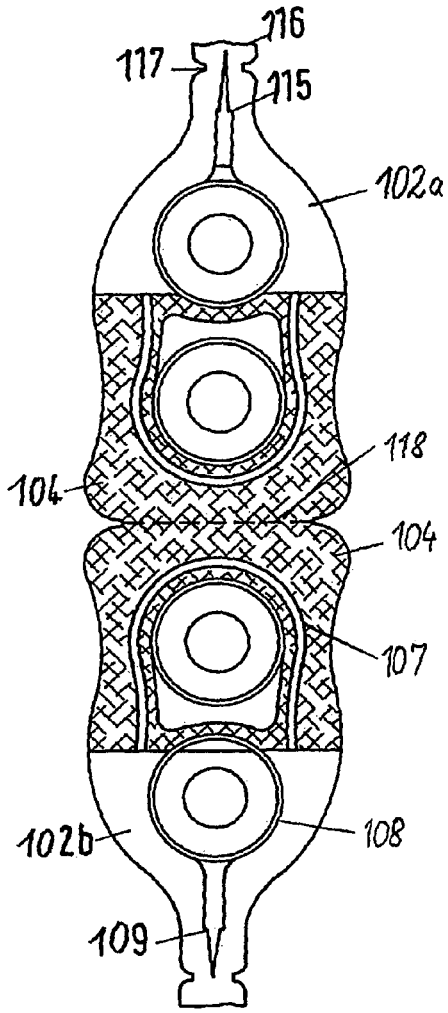

To apply the substances to an application site, an applicator 115, for example a brush-like applicator, can be provided in the dispensing channel 109 or arranged subsequent to it, as shown in FIGS. 9 and 10. For hygiene reasons, the applicator is sealed in a film or covered by a cap 116, which can be removed from the carrier 102 along a perforation 117. Only when the device according to the invention is put into use is this cap 116, that serves as a protective covering, torn open or off, so that the substance that exits from the dispensing channel 109 can be applied to a tooth, for example, using the applicator 115. As shown in FIGS. 9 and 10, the carrier segments 102*a* and 102*b* can be folded onto one another along the weakening lines 118, so that the depressions 103*a* and 103*b* come to rest on the depressions 103*c* and 103*d*, respectively. In this connection, two cover films 104, shown with cross-hatched lines in FIG. 9, are arranged between the depressions 103*b* and 103*d*, while the depressions 103*a* and 103*c* form a common chamber.

Figure 11:
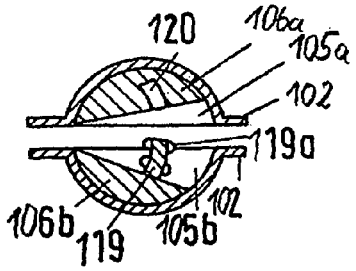
FIG. 11 a device according to an eighth embodiment of the invention, having two chambers, FIG. 12 a device according to a ninth embodiment of the invention, having two chambers, and FIG. 13 a device according to another embodiment of the invention, having four chambers.

Another embodiment of the inserts 106 is shown schematically in FIG. 11. In two opposite chambers 105*a*, 105*b*, two inserts 106*a*, 106*b* that interact with one another are provided, one of which is provided with an engagement rod 119 having engagement elements 119*a*, and the other of which is provided with a corresponding bore 120. When the inserts 106*a*, 106*b* are pressed against one another, resistance can be felt or a noise can be heard when the engagement elements 119*a* engage in the bore 120, in each instance, so that the user recognizes that a defined amount of the substance was dispensed. In this manner, metering even of very small amounts of the substance to be dispensed is possible, as this is required, for example, for dental bleaching material.

Figure 12:
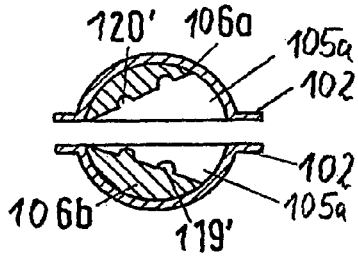

As an alternative to the configuration of the inserts shown in FIG. 11, these can also, as shown in FIG. 12, be provided with several projections 119' and corresponding depressions 120', in order to facilitate metering of the substance to be dispensed. With this embodiment, as well, resistance can be felt or a noise can be heard when the projections 119' engage in the depressions 120', in each instance, so that the user recognizes that a defined amount of the substance was dispensed. In this connection, the projections 119' into the depressions 120' are preferably arranged, relative to one another, in such a manner that the same volume is dispensed between the engagement of two adjacent projections 119' into the depressions 120'.

In the embodiments according to FIG. 11 or 12, the chambers 105*a* and 105*b* can be separated from one another by means of one or more cover films, not shown. These cover films are broken open by the engagement rod 119 or the projections 19' when the inserts 106*a*, 106*b* are pressed against one another.

Figure 13:
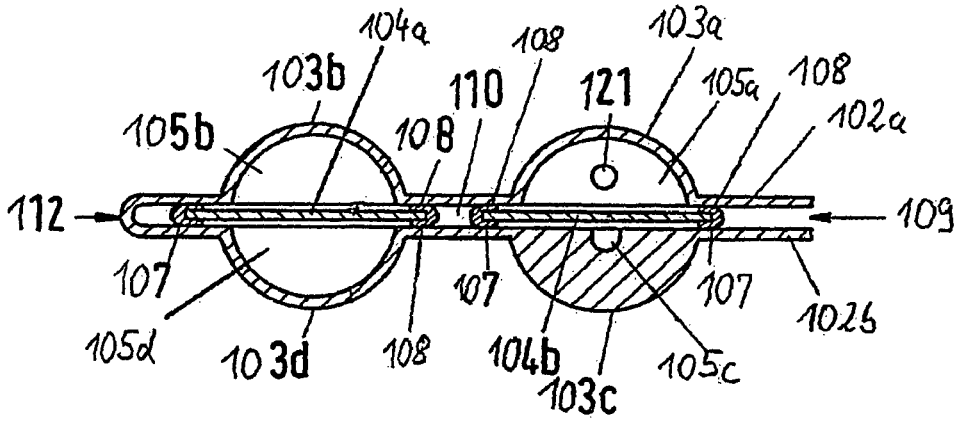

FIG. 13 shows another embodiment that has four depressions 103*a* to 103*d* in two carrier segments that are folded onto one another along the bending line 112, and accordingly, four chambers 105*a* to 105*d*. The chambers are closed off by cover films 104*a* and 104*b*, which are sealed, relative to the carrier segments, in each instance, by way of a circumferential seal 107 having planned breakage points 108. If viscous substances are accommodated in the chambers 105*b* and 105*d*, for example, these can be introduced into the chamber 105*a* that serves as a mixing space by means of pressure. In this connection, the planned breakage points 108 of the seal 107 are broken open, so that a connection channel 110 forms between the chambers 105*a*, 105*b*, and 105*d*. On the bottom side of the cover film 104*b* in the figure, no planned breakage point is provided in the seal 107, so that the chamber 105*c* remains sealed from the connection channel 110.

A mixing ball 121 is provided in the chamber 105*a*, with which the substances can be mixed by means of shaking. In order to be able to completely dispense the mixed substances from the chamber 105*a* through the dispensing channel 109, the chamber 105*c* that lies opposite this chamber 105*a* is configured in such a manner that the mixing ball 121 can be pressed through the cover film into the chamber 105*c*. As an alternative to the configuration of the chamber 105*c* shown in FIG. 13, this can also have essentially the same size as the other chambers 105*a*, 105*b*, and 105*d*, and be provided with an insert in which the mixing ball 121 can be accommodated when the chamber 105*a* is supposed to be emptied. Also, several mixing balls 121 can be provided in the chamber 105*a*. The chamber 105*c* or an insert arranged in it is then preferably configured to accommodate several balls.

| Reference Symbol List | |
|---|---|
| 1 | storage and dispensing device |
| 2 | carrier |
| 2a, 2b | carrier segments |
| 2c | edge of the carrier 2 |
| 3a, 3b | depressions |
| 3a', 3b' | chambers (storage chambers) |
| 4' | chamber (storage and/or mixing chamber) |
| 4'' | phial-like applicator |
| 4a, 4b | depressions |
| 5 | cover film |
| 6 | inserts |
| 7 | bending line |
| 8, 8a, 8b | connection channels |
| 8c | partition wall |
| 8' | channel halves |
| 9 | dispensing channel |
| 9' | channel halves |
| 10 | planned breakage point |
| 13 | mixing device |
| 14 | planned breakage point |
| 15 | planned breakage point |
| 101 | storage and dispensing device |
| 102 | carrier |
| 102a, 102b | carrier segments |
| 103, 103a-103d | depressions |
| 104, 104a, 104b | cover film |
| 105, 105a-105d | chamber |
| 106, 106', 106a, 106b | insert |
| 107 | seal |
| 108 | planned breakage point |
| 109 | dispensing channel |
| 110 | connection channel |
| 111 | step |
| 112 | bending line |
| 113 | mixing device |
| 113a | mixing helix |
| 113b | passage bore |
| 114 | groove |
| 115 | applicator |
| 116 | cap |
| 117 | perforation |
| 118 | weakening line |
| 119, 119' | engagement rod (projection) |
| 119a | engagement element |
| 120, 120' | bore (depression) |
| 121 | mixing ball |

What is claimed is:

1. Device for storing and dispensing viscous substances, which are to be mixed from at least two components for use, having a film-like carrier, in which at least three or four depressions are formed, which are open towards the top, at first, so that one of the components, in each instance, is introduced from the top into one of two center depressions, in each instance, wherein the two center depressions are adjacent and are arranged at essentially the same distance from a bending line, and afterwards, the two center depressions are sealed with a cover film towards the outside, forming a chamber, in each instance, in such a manner that between each center chamber and at least one adjacent outer depression, a connection channel that opens towards at least one outer depression when pressure is applied to the center chamber, in each instance, by way of a respective first planned breakage point, remains, and in this way, the components located in the two center chambers are mixed in at least one of a third chamber and the connection channels that are connected with one another, which third chamber is formed by folding the two carrier segments that are connected with one another by way of the bending line onto one another, by the at least one or the two outer depressions that thereby cover each other, upside down, as a result, whereby after the two carrier segments have been folded on top of one another, the third chamber is also sealed towards the outside.

2. Device according to claim 1, wherein the two first chambers lie essentially covering one another after the two carrier segments have been folded or placed onto one another.

3. Device according to claim 1, wherein the first planned breakage points permit transport of the components, in each instance, only in the direction of a dispensing channel, after they are opened.

4. Device according to claim 1, wherein in at least one of the two depressions assigned to each other, into which one of the components is introduced or which form the chamber that accommodates the mixture of the components, at least one insert comprising substantially non-resilient material having a flat or slanted surface is arranged.

5. Device according to claim 4, wherein the at least one insert comprises first and second insert, wherein said first and second inserts are arranged in depressions and lie parallel or conically relative to one another with their flat surfaces.

6. Device according to claim 4, wherein the at least one insert comprises first and second inserts, wherein said first and second inserts are arranged in depressions and are adjusted relative to one another with their flat surfaces, in steps.

7. Device, according to claim 1, further comprising a dispensing channel that opens by way of a second planned breakage point, wherein when pressure is applied to at least one of the chambers, a viscous substance exits from the dispensing channel and is applied to an application site, and further comprising a mixing device for the substances that flow through.

8. Device according to claim 7, wherein the mixing device has a tube-shaped region set onto the dispensing channel, on the inside of which two opposite radial grooves are made, the dimensions of which are adapted to at least one of the dimensions of the carrier and the dimensions of the cover film.

9. Device according to claim 7, wherein the mixing device has a mixer helix.

10. Device according to claim 1, wherein the carrier or the carrier segments are formed in strips.

11. Arrangement of devices for storing and dispensing viscous substances according to claim 1, wherein at least one of several carriers, carrier segments, and cover films are connected with one another in chain-like and releasable manner.

12. Device for storing and dispensing viscous substances, which are to be mixed from at least two components for use, the device having two carrier segments, wherein one of which has at least two depressions, which are open towards the top, at first, and the other of which has at least one depression that is open towards the top, so that one of the components, in each instance, is introduced from the top into one depression of the two carrier segments, in each instance, and afterwards, the depressions that contain the components are sealed with a cover film each or a common cover film, towards the outside, forming a first chamber, in each instance, in such a manner that between the first chamber, in each instance, and the adjacent additional depression, in each instance, a connection channel that opens when pressure is applied to the first chamber, in each instance, by way of a planned breakage point, remains, and in this way, the components located in the two first chambers are mixed in at least one of a third chamber and the connection channels that are connected with one another, which third chamber is formed by placing the two carrier segments onto one another with their tops, and the adjacent additional depressions that thereby cover each other, upside down, as a result, whereby after the two carrier segments have been placed or flipped on top of one another, the third chamber is sealed towards the outside.

13. Device according to claim 12, wherein a mixing device for the substances flowing through there is provided in at least one of the connection channel and the dispensing channel.

14. Device according to claim 12, wherein the dispensing channel narrows towards its exit end, in the manner of a cannula.

15. Device according to claim 12, wherein the third chamber is configured in phial-like manner, as an applicator, and wherein walls of the phial-like applicator are configured to be elastically resilient, at least in certain regions.

16. Device for storing and dispensing viscous substances, having a film-like carrier in which at least two depressions open on one side are formed for receipt of at least one substance introduced into the depressions, and afterwards sealed with a cover film, towards the outside forming chambers in such a manner that when pressure is applied to at least one of the chambers, a dispensing channel that opens by way of a planned breakage point, remains for application of the viscous substance exiting from the dispensing channel to an application site, wherein an applicator is inserted into the dispensing channel for the substances that flow there through, said applicator being fully sealed and encased by said film-like carrier and said cover film.

* * * * *

UNITED STATES PATENT AND TRADEMARK OFFICE

CERTIFICATE OF CORRECTION

PATENT NO. : 7,887,231 B2
APPLICATION NO. : 12/589098
DATED : February 15, 2011
INVENTOR(S) : Suchan et al.

It is certified that error appears in the above-identified patent and that said Letters Patent is hereby corrected as shown below:

In particular, in Column 18, line 18 (line 2 of Claim 5), after the word "second", please change "insert" to: --inserts--.

Signed and Sealed this
Twelfth Day of April, 2011

David J. Kappos
*Director of the United States Patent and Trademark Office*